US010731808B2

(12) United States Patent
Ferrari et al.

(10) Patent No.: US 10,731,808 B2
(45) Date of Patent: Aug. 4, 2020

(54) LUMINAIRE WITH MULTIPLE LIGHT EMISSIVE SURFACES

(71) Applicant: SIGNIFY HOLDING B.V., Eindhoven (NL)

(72) Inventors: Elena Tiziana Ferrari, Eindhoven (NL); Ronald Cornelis De Gier, Eindhoven (NL); Silvia Maria Booij, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 109 days.

(21) Appl. No.: 15/129,578

(22) PCT Filed: Mar. 27, 2015

(86) PCT No.: PCT/EP2015/056816
§ 371 (c)(1),
(2) Date: Sep. 27, 2016

(87) PCT Pub. No.: WO2015/144925
PCT Pub. Date: Oct. 1, 2015

(65) Prior Publication Data

US 2017/0138553 A1 May 18, 2017

(30) Foreign Application Priority Data

Mar. 27, 2014 (EP) ..... 14161883

(51) Int. Cl.
*F21S 8/06* (2006.01)
*F21V 7/00* (2006.01)
(Continued)

(52) U.S. Cl.
CPC ..... *F21S 8/061* (2013.01); *F21S 8/06* (2013.01); *F21V 3/00* (2013.01); *F21V 5/002* (2013.01);
(Continued)

(58) Field of Classification Search
CPC ..... F21S 8/061; F21V 15/01; F21V 5/002; F21V 7/0008; F21V 7/0016;
(Continued)

(56) References Cited

U.S. PATENT DOCUMENTS 2,436,635 A * 2/1948 De Bishop, Jr. ..... F21S 8/04 362/224
2,474,308 A * 6/1949 Franck ..... F21S 8/04 362/224
(Continued)

FOREIGN PATENT DOCUMENTS

DE 10103321 * 1/2001 ..... F21S 8/068
DE 102006019924 A1 8/2007
(Continued)

OTHER PUBLICATIONS

English Machine Translation of Engel (DE 10103321) provided by Espacenet.*

*Primary Examiner* — Zheng Song
(74) *Attorney, Agent, or Firm* — Akarsh P. Belagodu

(57) ABSTRACT

A luminaire comprising a housing having a first main face opposite a second main face at a distance W. The first main face comprises a light exit window transmissive for light source light, is bordered by at least one sidewall connecting the first and second main face, and has a length L. The sidewall comprises essentially over its full length L a light emission window which is transmissive for light source light and which has a height H, with H in between 0.1*W to 0.8*W.

20 Claims, 3 Drawing Sheets

(51) Int. Cl.

| | |
|---|---|
| ***F21V 15/01*** | (2006.01) |
| ***F21V 3/00*** | (2015.01) |
| ***F21V 5/00*** | (2018.01) |
| *F21Y 103/00* | (2016.01) |
| *F21Y 113/20* | (2016.01) |
| *F21Y 115/10* | (2016.01) |
| *F21Y 113/00* | (2016.01) |
| *F21Y 105/10* | (2016.01) |
| *G10K 11/162* | (2006.01) |

(52) U.S. Cl.
CPC ..... *F21V 7/0016* (2013.01); *F21V 15/01* (2013.01); *F21Y 2103/00* (2013.01); *F21Y 2105/10* (2016.08); *F21Y 2113/00* (2013.01); *F21Y 2113/20* (2016.08); *F21Y 2115/10* (2016.08); *G10K 11/162* (2013.01)

(58) Field of Classification Search
CPC ..... F21Y 2103/00; F21Y 2105/10; F21Y 2113/20; F21Y 2115/10
See application file for complete search history.

(56) References Cited

U.S. PATENT DOCUMENTS

| | | | | | |
|---|---|---|---|---|---|
| 4,768,140 | A * | 8/1988 | Szpur | F21S 6/002 | 362/263 |
| 5,537,304 | A * | 7/1996 | Klaus | F21S 8/04 | 362/147 |
| 6,161,939 | A | 12/2000 | Bansbach | | |
| 6,174,069 | B1 * | 1/2001 | Plunk | F21S 8/06 | 362/147 |
| 6,428,183 | B1 * | 8/2002 | McAlpin | F21S 8/06 | 362/147 |
| 2008/0259616 | A1 * | 10/2008 | Morgan | E04B 9/001 | 362/404 |
| 2008/0273323 | A1 * | 11/2008 | Ladstaetter | F21S 8/04 | 362/231 |
| 2009/0003002 | A1 | 1/2009 | Sato | | |
| 2010/0172152 | A1 * | 7/2010 | Boonekamp | F21V 7/0008 | 362/609 |
| 2011/0013420 | A1 | 1/2011 | Coleman et al. | | |
| 2012/0294007 | A1 * | 11/2012 | Matsumoto | F21S 8/026 | 362/249.02 |
| 2013/0027927 | A1 | 1/2013 | Claus et al. | | |

FOREIGN PATENT DOCUMENTS

| | | | | |
|---|---|---|---|---|
| DE | 102012205188 | A1 | 10/2013 | |
| EP | 1279889 | * | 7/2001 | F21S 8/04 |
| EP | 1538394 | A2 | 6/2005 | |
| EP | 2479480 | A1 | 7/2012 | |
| EP | 2634474 | A1 | 9/2013 | |
| EP | 2653775 | A1 | 10/2013 | |
| JP | S48-579850 | U | 7/1973 | |
| JP | 2007-280733 | A | 10/2007 | |
| JP | 2008218238 | A | 9/2008 | |
| JP | 2010192228 | A | 9/2010 | |
| JP | 2010205422 | A | 9/2010 | |
| JP | 2011154872 | A | 8/2011 | |
| KR | 10-2012-013707 | A | 2/2012 | |
| RU | 40781 | U1 | 9/2004 | |
| WO | WO2007113680 | A2 | 10/2007 | |
| WO | WO2009072386 | A1 | 6/2009 | |
| WO | WO2012144657 | A1 | 10/2012 | |

* cited by examiner

LUMINAIRE WITH MULTIPLE LIGHT EMISSIVE SURFACES

CROSS-REFERENCE TO PRIOR APPLICATIONS

This application is the U.S. National Phase application under 35 U.S.C. § 371 of International Application No. PCT/EP2015/056816, filed on Mar. 27, 2015, which claims the benefit of European Patent Application No. 14161883.5, filed on Mar. 27, 2014. These applications are hereby incorporated by reference herein.

FIELD OF THE INVENTION

The invention relates to a luminaire comprising a housing with a first main face opposite a second main face at a distance W, the housing being configured to accommodate a light source for generating light source light, the first main face comprising a light exit window transmissive for light source light and being bordered by at least one sidewall having a length L and transversely extending from the first main face.

BACKGROUND OF THE INVENTION

A luminaire of the type as described in the opening paragraph is known from EP2634474A1. It is a known problem with these types of luminaries that a relatively large thickness, i.e. a relatively high sidewall, is required, for example, because of the space required to accommodate luminaire components such as voluminous, acoustic material, light sources, wiring, electronics, heat sinks etc. Often these luminaires are applied as pendant luminaires and thereto are suspended from the ceiling to give the impression of a floating luminaire usually to illuminate office desks and conference tables for people to work. However, due to the large width, or height or thickness of the sidewall of these pendant luminaries, the issue arises that people working below these pendant luminaires feel uncomfortable because of the impression of rather heavy and thick luminaires being suspended over their heads. The known luminaire solves this issue by positioning luminaire components of relatively large height at a central region of the first and second main face, i.e. remote from the sidewall. The housing then being thick in its central region and being slim in a peripheral region, i.e. close to the sidewall. However, this solution involves the disadvantages of elongated wiring and relatively little room being available for the accommodation of luminaire components with the subsequent risk on early failure of electronic components because heat generating or heat dissipating component, for example heat sinks, and heat sensitive electrical components are positioned relatively close to each other.

DE102012205188A1 discloses a luminaire having a light exit window in a first main face and a light emission window in a sidewall which both are associated with the same light source.

SUMMARY OF THE INVENTION

It is an object of the invention to provide a luminaire of the type as described in the opening paragraph in which the abovementioned disadvantage is counteracted. Thereto the luminaire further comprises a first edge of the sidewall bordering the first main face, the sidewall comprises a light emission window which is transmissive for light source light and which has a height H, with H>0 and <W, for example with H in between 0.1*W to 0.8*W, the light exit window is associated with a first light source and the light emission window is associated with a second light source. By these measures the luminaire renders to have a reduced thickness/height impression compared to its actual physical height/thickness. Yet in the inventive luminaire, ample room is available for the accommodation of luminaire components and the risk on early failure of electronic components is reduced because heat generating/dissipating components and heat sensitive (electrical) components can be positioned relatively remote from each other. As the electric components can be arranged inside the housing at ones desire, elongated wiring can be obviated.

The light emission window can be formed by one, continuous light transmissive area, i.e. the surface area of the light emission window is the same as the surface area of the light transmissive area. Alternatively, the light emission window can be formed by a large number, for example 100, 10000 or 250000, of relatively small light transmissive sub-windows. The large number of relatively small light transmissive sub-windows virtually makes up the same surface area as the surface area of the light emission window, but physically the sum of the individual surface sub-windows is less than the surface area of the light emission window. These sub-windows could be embodied as, for example, round dots, square dots, elongated stripes like a zebra pattern, dots formed by concentric circles or a number, for example four, of parallel, wave-shaped stripes. From relatively large distances these sub-windows merge into one large light emission window and virtually form one light transmissive area, while when being observed form relatively small distances they render the luminaire to have an aesthetic, decorative feature.

The effect of light being issued from the sidewall is that it masks the actual height of the luminaire as edges of the sidewall are difficult to perceive and/or that it seems that the light exit window of the first main surface is extended with the light emission window of the sidewall. The quality of this effect depends on the balance between the luminous flux from the light exit window of the first main face, the ambient light level and the luminous flux from the light emission window of the sidewall as well as from the distance and size of the light emission window from the light exit window.

It is also for reasons of prevention of glare that the luminaire according to the invention is characterized in that the light exit window is associated with a first light source and that the light emission window is associated with a second light source. The ratio in luminous flux between the first and second light source subsequently issued from the light exit window respectively the light emission window could be set to a predetermined favorable value, for example in light intensity and/or color, e.g. at a value or gradient which is suitable for light in offices. First and second light sources means, for example, that the first and second light sources each have a respective main issue direction of light, which for the first light source is towards the light exit window and for the second light source is towards the light emission window, or it means, for example, that the first and second light sources faces towards a respective window.

An embodiment of the luminaire of the invention is characterized in that H is in between 0.2*W to 0.4*W. This renders the luminaire to have an even more slim appearance, and yet H is sufficient to mask at least one edge with only limited risk on glare and with H still being relatively small. Thereto the light level at the light emission window preferably is a few times higher than the ambient light level, for example at least 10 times higher. The height H could be constant over the length L of the sidewall or, alternatively, the height H is variable over the length L of the sidewall. In the case of a variable height H, the height could be adapted to the shape of the first main face of the pendant luminaire. For example, in the case of an elongated rectangular first main face, the height H of the light emission window could be decreasing, for example in its length direction, towards the corners of the rectangle, suggesting a tapering construction of the luminaire and hence rendering the luminaire to look more sophisticated.

As long as at least one edge of the sidewall is masked, the actual thickness of the luminaire cannot be determined and hence in embodiments of the luminaire of the invention the light emission window can either extend from its first edge towards a second edge of the sidewall or the light emission window can extend from its second edge towards its first edge. Generally said sidewall is fully circumferential around the first main face, for example in the case the first main face has a circular or an elliptical shape. Alternatively the boundary of the first main face is formed by a number of discernable sidewalls, which could be identified, for example, when the first main face has a square, kite or rectangular shape, in which then at least one sidewall comprises a light emission window. In the case of more sidewalls, preferably each sidewall has a respective light emission window, and the height H of these light emission windows and/or the luminous flux issued from these light emission window either could mutually be the same or could be different. If the light emission window extends from the first edge towards the second edge and the light exit window extends over the whole first main surface, the light emission window and the light exit window together form, either physically or virtually, an integral light exit window. Generally the sidewall connects the first main face with the second main face to form a closed housing and thus to counteract accumulation of dust inside the housing, but alternatively the housing could be of a "box and lid" construction for easy assembling. The first and second main faces then have respective (partial) sidewalls and could then be mutually connected via special, separate parts, for example spacers.

The risk on glare should be taken in consideration and being avoided, for example by an appropriate setting of the luminous flux issued via the light emission window or by a directionality below critical angles of 65° between the normal to the light exit window and the (main direction of the) light beam as issued from the light emission window. This can be obtained, for example, by providing the light emission window with a refractive/reflective structure, for example a grating, a Fresnel lens, a meso-optic structure or a micro-lens optic, which at the light emission window redirects the light source light into the desired direction, or alternatively by providing the light source with optics, for example a parabolic reflector/collimator which results in a narrow beam of light source light in the desired direction towards the light emission window. It could be favorable to have low light level light emission from the light emission window at angles larger than 65° to generate a subtle ambient lighting without causing glare. Furthermore, such low brightness emission from the light emission window enables a simple check from relatively large distances from the luminaire on the operation state of the light sources, i.e. if the light sources of the luminaire are switched on/off.

An embodiment of the luminaire is characterized in that the first light source has main light issue direction towards the light exit window and that the second light source has a main light issue direction towards the light emission window. Easier control of light intensity is than obtained and a larger range of light intensity settings is than enabled. Yet an embodiment of the luminaire is even more preferred which is characterized in that the first and second light source are independently controllable, for example and preferably, in that the first and second light sources have separate electrical connections and/or are mounted on respective, separate PCB's. The level and ratio in luminous flux as issued from the light exit window and light emission window is then even more easily adjustable to the ambient conditions and hence the desired masking effect can even more easily be optimized.

This feature of light sources being individually controllable is in particular of interest in an embodiment of the luminaire according to the invention in which the second main face comprises a further light exit window. Both luminous flux and color (temperature) of the light source light issued through the various light emission exit windows are than adjustable as desired.

An embodiment of the luminaire is characterized in that a circumferential Non-light emitting region is comprised in between the light exit window and the light emission window. This non-light emitting region can be attained by the light emission window in the sidewall extending from its second edge towards its first edge and/or that the light exit window does not extend over the whole first main face, or the light exit window extends over the whole first main face and the light emission window extends from the second edge towards the first edge of the sidewall. These embodiments of the inventive luminaire give the positive impression of a relatively very flat luminaire floating in an illuminated, somewhat thicker ring. It is also possible to have a double ring around the light exit window. Thereto an embodiment of the luminaire of the invention is characterized in that the sidewall comprises the light emission window and a further light emission window mutually separated by a light blocking band with height HB, HB being in the range of 0.2*W to 0.6*W. In the embodiment of the luminaire according to the invention in which both the first and second main face comprise a respective light exit window, these could be matched with a respective one of the light emission window comprised in the sidewall.

In the case the light exit window extends over the whole first main face, it is possible to connect two or more luminaires so that their first sidewalls abut each other and that their first main faces are optically perceived as one integral face, hence that virtually one enlarged illuminated light exit window is formed. It is thus enabled to create a continuous light emitting (false) ceiling.

An embodiment of the luminaire according to the invention is characterized in that the housing comprises acoustic absorptive material. In particular acoustic absorptive luminaires are relatively thick, their thickness being required to obtain sufficiently reduction of undesired noise/sound, and the inventive measures renders these types of luminaires to look thinner and more aesthetically attractive.

It is possible for embodiments of the luminaire according to the invention to have exchangeable light sources or that it comprises fixed, built-in light source(s). In particular in the case LEDs are used as light sources it is quite convenient to have the light source(s) already built-in the housing of the luminaire as the lifetime of the LED(s) is such that exchange of the light source for reasons of failure is not considered necessary.

Where in this description and claims it reads "light source", this expression could refer to at least one single light source such as a single LED, a low pressure mercury discharge fluorescent lamp, a high pressure gas discharge lamp, or it could refer to at least one array of (similar) light sources such as a number of LEDs mounted on a PCB or an array of halogen incandescent lamps, or it could refer to at least one plurality of primary light sources which together form a composed light source such as RGB(A)-LEDs which together form a white LED light source.

The first main face and/or the second main face of the luminaire could be flat faces, but alternatively could be faceted, slightly curved or have a subtle wave-like curvature. Generally the first and second main face are arranged in parallel to each other, but alternatively, one of the first and second face could be flat while the other face is curved, faceted or has a wave-like curvature.

The expression "the sidewall bordering the first main face" is to comprise both embodiments in which the sidewall is in physical contact with the first main face, and embodiments in which the sidewall forms a virtual boundary of the first main face. In other words, there may be a relatively small gap, for example a gap with a width of at the most 5% of the dimension of the first main face in the same direction, in between the first edge of the sidewall and the physical border of the first main face.

Alternatively to pendant luminaires, the luminaire according to the invention can also be mounted on walls and facades. If these luminaires are mounted for acoustic dimming purposes, a relatively large thickness (W) to sufficiently absorb sound/noise is required. Also for these luminaires it is desired to have a visually more aesthetical appearance and hence the invention applies to pendant, ceiling mounted and wall mounted luminaires.

BRIEF DESCRIPTION OF THE DRAWINGS

The invention will now be further elucidated by means of the schematic drawings, in which.

DESCRIPTION OF PREFERRED EMBODIMENTS

Figure 1:
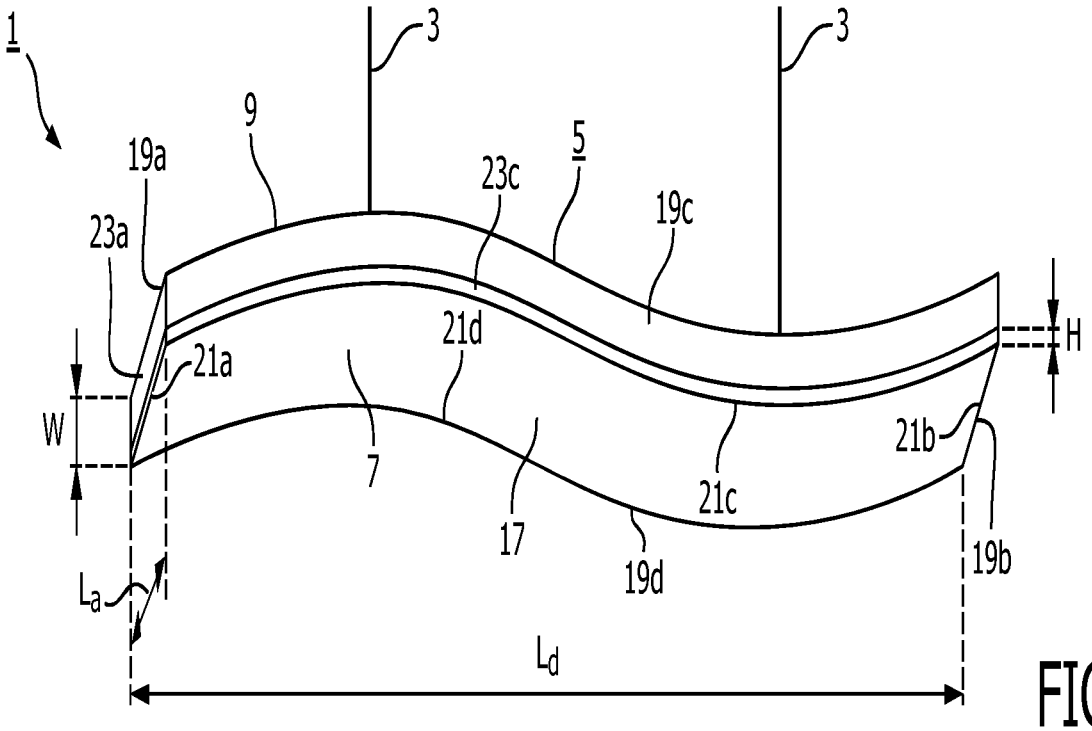
FIG. 1 shows a perspective view from below of a first embodiment of the luminaire according to the invention.

FIG. 1 shows a perspective view from below of a first inventive embodiment of a luminaire 1 having a subtle wave-like curvature and being electrically connected to mains and suspended from a ceiling via suspension cables 3. The luminaire comprises a housing 5 having a first main face 7 opposite a second main face 9 at a distance W and which housing accommodates a light source (not shown) for generating light source light (not shown). The first main face comprises a diffuser as a light exit window 17 which extends over the whole first main face, which is diffusely transmissive for light source light and which is bordered by at least four sidewalls 19*a,b,c,d* each having a respective length La,b,c,d and transversely extending from the first main face. A respective first edge 21*a,b,c,d*, of each sidewall borders the first main face. Each sidewall comprises essentially over its full length L a respective light emission window 23*a,b,c,d* which is transmissive for light source light and which has a height H, with H being about 0.25*W. The light emission windows border with their first edges the light exit window.

Figure 2:
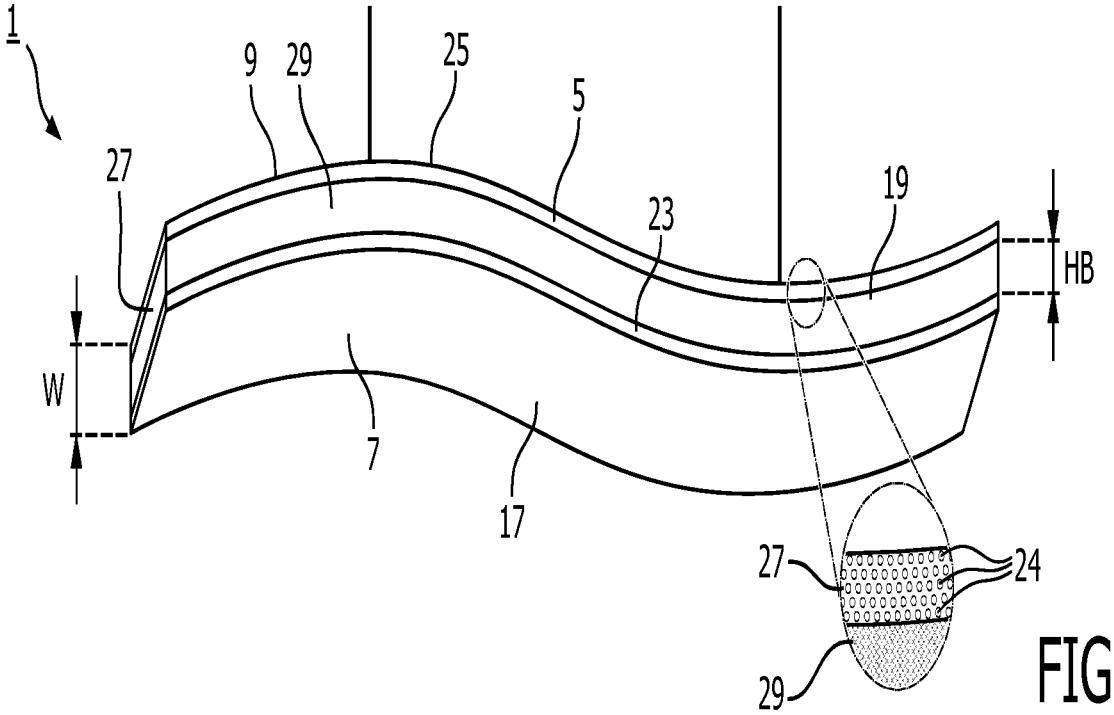
FIG. 2 shows a perspective view from below of a second embodiment of the luminaire according to the invention.

FIG. 2 shows a perspective view from below of a second embodiment of a pendant luminaire 1 according to the invention. The luminaire comprises a housing 5 having a first main face 7 opposite a second main face 9 at a distance W and which housing accommodates a light source (not shown) for generating light source light (not shown). The first main face comprises a light exit window 17 and the second main face 9 comprises a further light exit window 25. The sidewall 19 comprises light emission windows 23 and a further light emission window 27 mutually separated by a light blocking band 29 having a height HB of 0.55*W. The further light emission window is formed by a large number, in this case about 25000, of relatively small light transmissive sub-windows 24 embodied as round dots. From relatively large distances these sub-windows merge into one large light emission window and virtually form one light transmissive area, while when being observed form relatively small distances they render the luminaire to have an aesthetic, decorative feature, as shown in the detailed zoom view.

Figure 3:
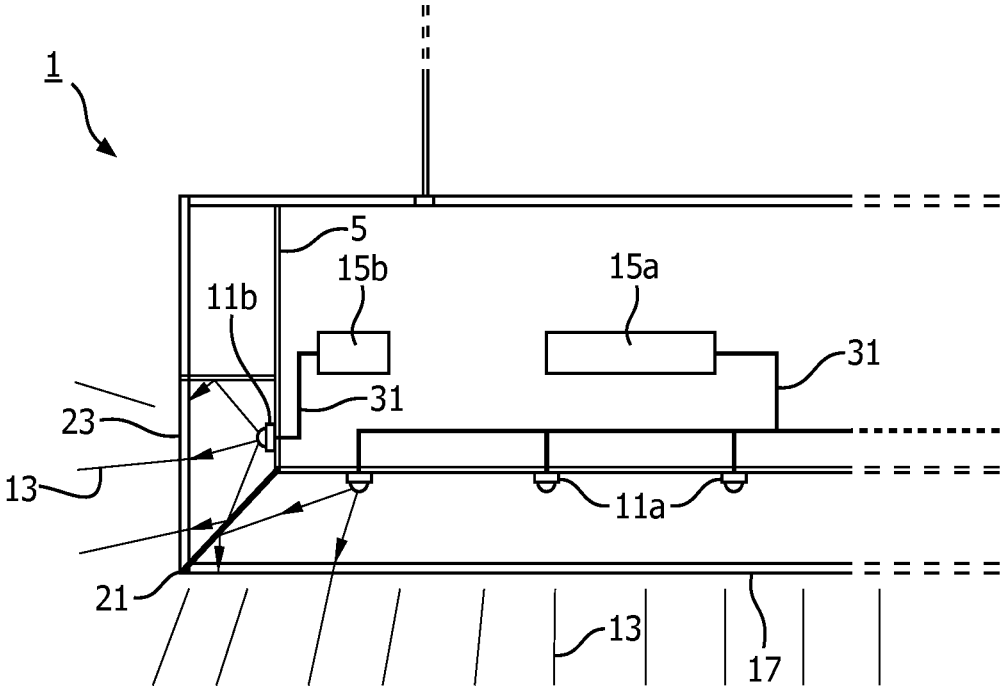
FIG. 3 shows a partial cross-section in length direction of a third embodiment of a luminaire according to the invention.

FIG. 3 shows a partial cross-section in length direction of a third embodiment of a luminaire 1 according to the invention. The luminaire has a housing 5 in which a light source 11, i.e. in the figure an array of first Lambertian LED light sources 11*a* and an array of second Lambertian LED light sources 11*b*, is accommodated. The luminaire further has a light exit window 17 associated with the array of first light sources and has a light emission window 23 associated with the array of second light sources. The light emission window borders with its first edge 21 the light exit window. Each array of light sources is controlled by a respective controller 15*a,b* to independently control the intensity/brightness of the associated array of light sources and thus to independently control the luminous flux of light source light 13 to be issued from the light exit window respectively the light emission window. Wiring 31 can be relatively short as the controller can be located close to its associated light source.

Figure 4:
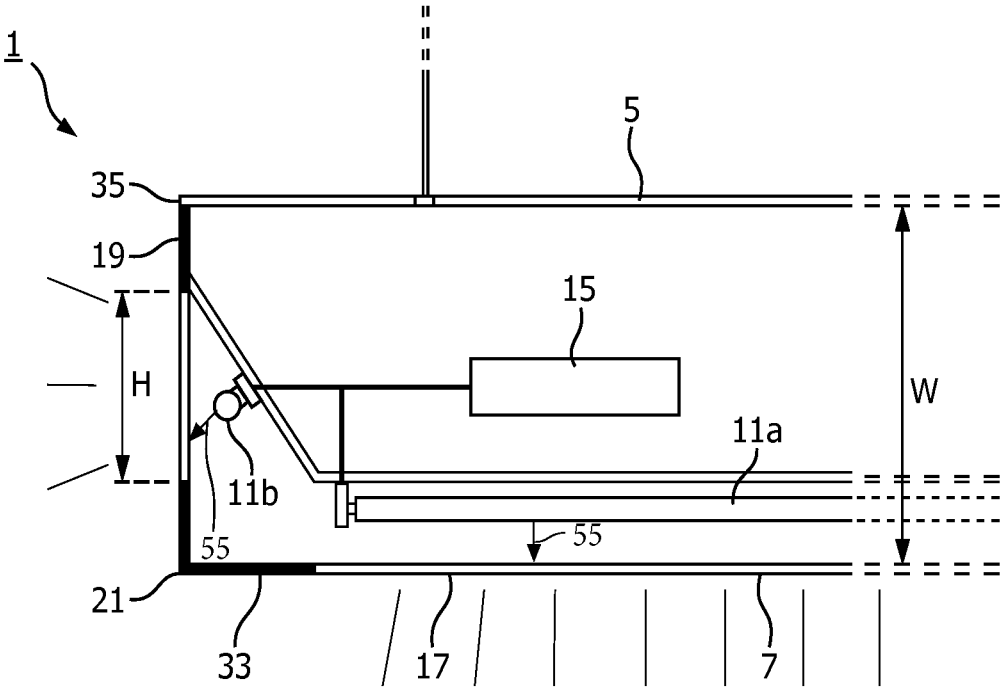
FIG. 4 shows a partial cross-section of a fourth embodiment of a luminaire according to the invention.

FIG. 4 shows a partial cross-section of a fourth embodiment of a luminaire 1 according to the invention similar to the cross section of FIG. 3. The light source 11 is accommodated in the housing 5 and in this embodiment comprises a pair of first elongated fluorescent tubes 11*a* as a first light source and a pair of second elongated fluorescent tubes 11*b* as a second light source. The fluorescent tubes 11*a* and 11*b* each are provided with a respective reflective coating on a respective side facing away from an associated window to render the fluorescent tubes 11*a* and 11*b* to have a main light issuing direction 55 towards the associated window. All the light sources are controlled by a single controller 15 and not independently controllable. The first main face 7 has a light exit window 17 which is surrounded by a circumferential non-light emitting region 33. The sidewall 19 has a light emission window 23 which neither borders neither the first edge 21 nor a second edge 35 of the sidewall, and which has a height H of about 0.5*W.

Figure 5:
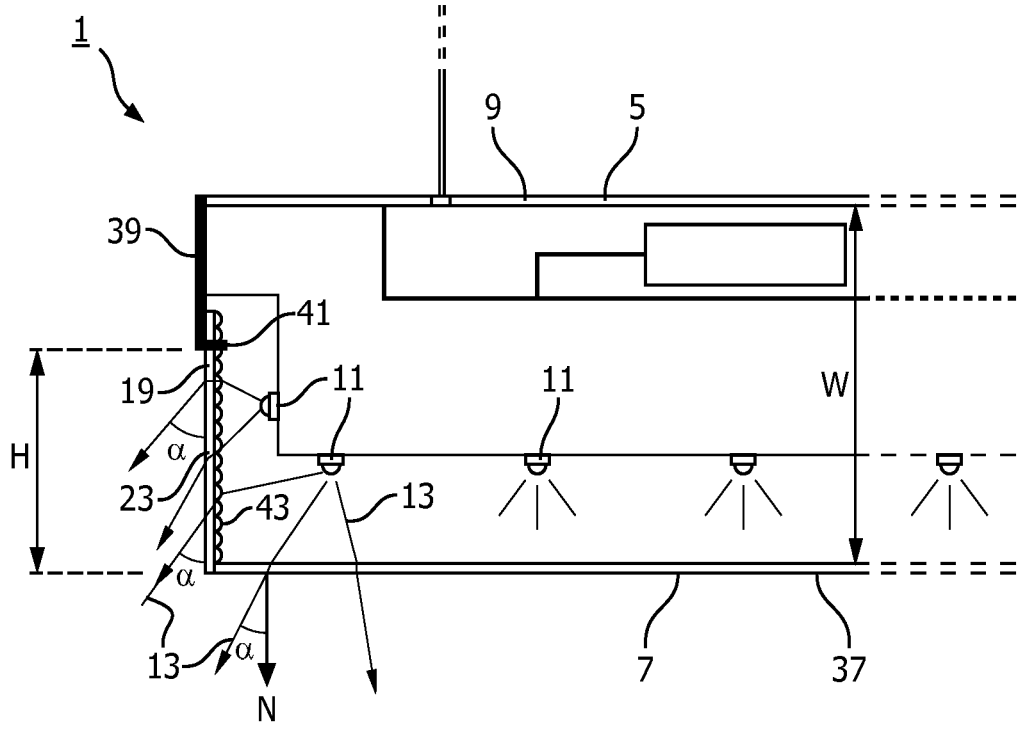
FIG. 5 shows a partial cross-section of a fifth embodiment of a luminaire according to the invention.

FIG. 5 shows a partial cross-section of a fifth embodiment of a luminaire 1 according to the invention similar to the cross section of FIG. 3. The housing 5 of the luminaire comprises a box 37 and a lid 39 mutually connected via special connectors 41, for example spacers. In this embodiment the sidewall 19 does not extend over the full distance W between the first 7 and second main face 9, in this embodiment the sidewall extends for about 65% over distance W. The light emission window 23 in the sidewall has height H which is also about 65% of W. The light emission window is provided with a meso-optic refractive structure 43, which however could be any refractive and/or reflective structure, for example a grating, a micro lens optic or Fresnel lens, which redirects light source light 13 in directions at smaller angles α than 65° with a normal N to the first main face. The housing not only accommodates the light source 11 but also accommodates acoustic absorptive material 45, rendering the luminaire to have a relatively large thickness (W) of, for example, about 10 to 15 cm.

Figure 6:
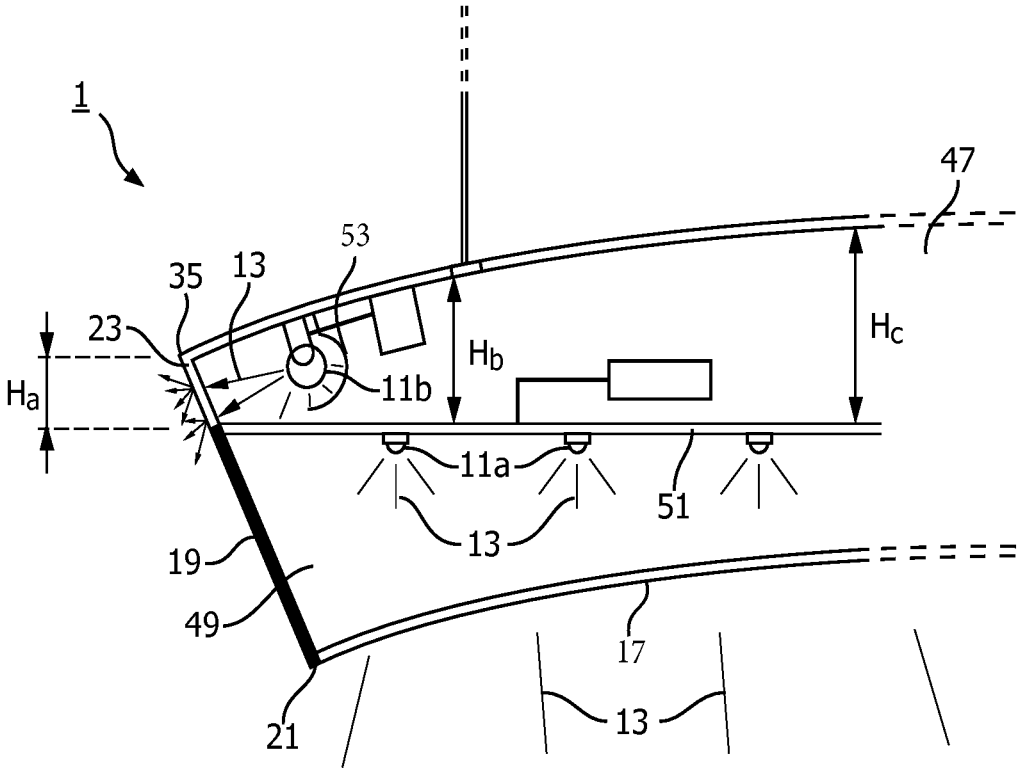
FIG. 6 shows a partial cross-section of a sixth embodiment of a luminaire according to the invention.

FIG. 6 shows a partial cross-section of a sixth embodiment of a luminaire 1 according to the invention similar to the cross section of FIG. 3. The luminaire is slightly curved and its sidewall 19 comprises a light emission window 23 which extends from the second edge 35 towards the first edge 21. The light emission window has a variable height Ha,b,c over the circumference of the sidewall and tapers from a central region 47 of the luminaire towards the peripheral region 49 of the luminaire. The light emission window is diffusely transmissive for light source light 13. The first light source 11*a* is an array of LEDs facing the light exit window and mounted on a PCB 51 and the second light source 11*b* is an elongated halogen incandescent lamp with a reflector 53 to render the main issue direction 55 of light from the second light source 11*b* to be towards the light emission window. The light sources 11*a* and 11*b* being independently controllable.

The invention claimed is:

1. A luminaire comprising a housing with a first main face opposite a second main face at a distance W and being configured to accommodate a plurality of light sources for generating light source light;

the first main face comprising a light exit window transmissive for light source light and being bordered about its periphery by at least one sidewall, the at least one sidewall having at least one corresponding length L and transversely extending from the first main face, and an edge bordering the first main face;

wherein the at least one sidewall comprises essentially over its full length L a light emission window transmissive for light source light and which has a height H, with H in between 0.1*W to 0.8*W, and wherein the light exit window is associated with a first light source of the plurality of light sources having a first main issue direction of light oriented toward the light exit window and each of the light emission windows is associated with a second light source of the plurality of light sources having at least one second main issue direction of light oriented toward the light emission windows; wherein the luminaire is characterized in that the height H is varied over the periphery of the of the at least one sidewall.

2. The luminaire as claimed in claim 1, wherein the height H is varied between 0.2*W to 0.4*W.

3. The luminaire as claimed in claim 1 wherein the at least one sidewall comprises a second edge and the light emission window extends from its first edge towards its second edge or the light emission window extends from its second edge towards its first edge.

4. The luminaire as claimed in claim 1, wherein the light exit window extends over the whole first main face.

5. The luminaire as claimed in claim 1, wherein a non-light emitting region is comprised in between the light exit window and the light emission window around the periphery of the at least one side wall.

6. The luminaire as claimed in claim 1, wherein the light emission window is formed by a plurality of light transmissive sub-windows.

7. The luminaire as claimed in claim 1, wherein the housing accommodates the plurality of light sources.

8. The luminaire as claimed in claim 1, wherein the first and second light sources are independently controllable.

9. The luminaire as claimed in claim 1, wherein the housing comprises acoustic absorptive material.

10. The luminaire as claimed in claim 1, wherein light source light is issued as a light beam from the light emission window at angles of at the most 65° between the normal to the light exit window and the light beam.

11. A luminaire as claimed in claim 1, wherein the second main face comprises a further light exit window.

12. A luminaire comprising a housing with a first main face opposite a second main face at a distance W and being configured to accommodate a plurality of light sources for generating light source light;

the first main face comprising a light exit window transmissive for light source light and being bordered about its periphery by at least one sidewall, the at least one sidewall having at least one corresponding length L and transversely extending from the first main face, and an edge bordering the first main face;

wherein the at least one sidewall comprises essentially over its full length L a light emission window transmissive for light source light and which has a height H, with H in between 0.1*W to 0.8*W, and wherein the light exit window is associated with a first light source of the plurality of light sources having a first main issue direction of light oriented toward the light exit window and each of the light emission windows is associated with a second light source of the plurality of light sources having at least one second main issue direction of light oriented toward the light emission, and wherein the at least one sidewall comprises a further light emission window separated from the light emission window by a light blocking band with height HB, HB being in the range of 0.2*W to 0.6*W.

13. The luminaire as claimed in claim 12, wherein the height H is varied between 0.2*W to 0.4*W.

14. The luminaire as claimed in claim 12 wherein the at least one sidewall comprises a second edge and the light emission window extends from its first edge towards its second edge or the light emission window extends from its second edge towards its first edge.

15. The luminaire as claimed in claim 12, wherein the light exit window extends over the whole first main face.

16. The luminaire as claimed in claim 12, wherein a non-light emitting region is comprised in between the light exit window and the light emission window around the periphery of the at least one side wall.

17. The luminaire as claimed in claim 12, wherein the light emission window is formed by a plurality of light transmissive sub-windows.

18. The luminaire as claimed in claim 12, wherein the first and second light sources are independently controllable.

19. The luminaire as claimed in claim 12, wherein light source light is issued as a light beam from the light emission window at angles of at the most 65° between the normal to the light exit window and the light beam.

20. A luminaire as claimed in claim 12, wherein the second main face comprises a further light exit window.

* * * * *